US007950081B2

(12) United States Patent
Chen et al.

(10) Patent No.: US 7,950,081 B2
(45) Date of Patent: May 31, 2011

(54) CHANGING TABLE FOR PLAYARD

(75) Inventors: Shun-Min Chen, Taipei (TW); Jianqun Li, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 718 days.

(21) Appl. No.: 11/878,479

(22) Filed: Jul. 25, 2007

(65) Prior Publication Data

US 2008/0034506 A1 Feb. 14, 2008

(30) Foreign Application Priority Data

Aug. 14, 2006 (CN) ..... 2006 2 0131122 U

(51) Int. Cl.
*A47D 7/00* (2006.01)

(52) U.S. Cl. ..... 5/93.2; 5/93.1; 5/99.1

(58) Field of Classification Search ..... 5/655, 93.1, 5/98.1, 99.1, 507.1, 503.1, 658, 93.2; 16/324, 16/326, 327; 403/92, 93, 91, 95, 99, 103, 403/104

See application file for complete search history.

(56) References Cited

U.S. PATENT DOCUMENTS

| | | | | |
|---|---|---|---|---|
| 1,473,436 | A * | 11/1923 | Leopold | 81/58.3 |
| 4,082,352 | A * | 4/1978 | Bales et al. | 297/364 |
| 5,542,151 | A * | 8/1996 | Stranski et al. | 16/326 |
| 6,102,479 | A * | 8/2000 | Wallace | 297/357 |
| 6,629,801 | B2 * | 10/2003 | Cheng | 403/101 |
| 6,948,197 | B1 * | 9/2005 | Chen | 5/93.1 |
| 2002/0166169 | A1 * | 11/2002 | Longenecker et al. | 5/93.1 |
| 2006/0130237 | A1 * | 6/2006 | Clapper et al. | 5/655 |
| 2008/0127412 | A1 * | 6/2008 | Pleiman et al. | 5/99.1 |
| 2009/0113624 | A1 * | 5/2009 | Tuckey | 5/93.1 |

* cited by examiner

*Primary Examiner* — Michael Trettel
*Assistant Examiner* — William Kelleher
(74) *Attorney, Agent, or Firm* — Bacon & Thomas PLLC

(57) ABSTRACT

This invention relates to a folding mechanism for a playard, which comprises first and second joints substantially cylindrical in shape. The joints have arcuate plates and stops that cooperative with each other to effect the rotation between the joints, so that the changing table can be moved between an operation position and a storage position. This invention may avoid accidental collapse of the changing table, and enable the users to conveniently fold/unfold the changing table single handed.

14 Claims, 10 Drawing Sheets

CHANGING TABLE FOR PLAYARD

FIELD OF THE INVENTION

The present invention relates generally to a changing table for a playard which is simple and easy to operate, and may preclude the changing table from folding or pressing down unintentionally.

BACKGROUND OF THE INVENTION

Changing tables for playards are well known in the prior art. A parent or caretaker can change a child's diaper or perform other baby caretaking tasks on a changing table that can be mounted to the top of the playard. The changing table, which is generally rectangular in shape, can be supported on its sides by upper frame supports of the playard. After the child's diaper has been changed, the changing table can be removed from the playard, or in some applications, can be swung about an upper frame support of the playard to a storage position exterior of the playard. In this respect, the parent or caretaker can lift one side of the changing table and can swing the changing table about the upper frame support to its storage position at an exterior side of the playard. The changing table can then rest in its storage position exterior of the playard.

An exemplary apparatus in the prior art is described in U.S. Pat. No. 6,543,070 incorporated herein by reference. In this conventional changing table, the folding arms are designed to pivot about the pivot joint, and thus the changing table can be swung about the upper frame support of the playard to its storage position. However, this changing table has a disadvantage in that, when the baby is placed on the changing table, a rolling movement of the baby or the changing table is turned by the caretaker may result in the folding arms pivoting about the pivot joint accidently, and this may harm the baby.

SUMMARY OF THE INVENTION

The main objective of the present invention is to provide a changing table for a playard which tends to obviate the aforementioned problem. The changing table according to the present invention enables the child caretakers to conveniently move the changing table between an operation position and a storage position. The present invention may overcome the defects of the conventional changing tables, such as accidental collapse and harm to the child and caregiver. Furthermore, the present invention is low in manufacturing cost since the components thereof are relatively less than those of conventional ones.

This invention relates to a folding mechanism for a playard, which comprises first and second joints substantially cylindrical in shape. The joints have arcuate plates and stops that cooperative with each other to effect the rotation between the joints, so that the changing table can be moved between an operation position and a storage position. This invention may avoid accidental collapse of the changing table, and the users to conveniently fold/unfold the changing table by pulling or pressing the rail of the changing table with single hand.

Additional features and advantages of the present invention will be set forth in the description to follow. The objectives and other advantages of the invention will be realized and attained by the structure particularly pointed out in the written description and claims as well as the appended drawings.

BRIEF DESCRIPTION OF THE DRAWINGS

The present invention will now be described with reference to the accompanying drawings illustrating preferred embodiments, in which:

FIG. 5 also shows the state in which the changing table is in the operation position.

FIG. 12 also shows the state in which the changing table is in the operation position.

DETAILED DESCRIPTION OF THE PREFERRED EMBODIMENTS

Figure 1:
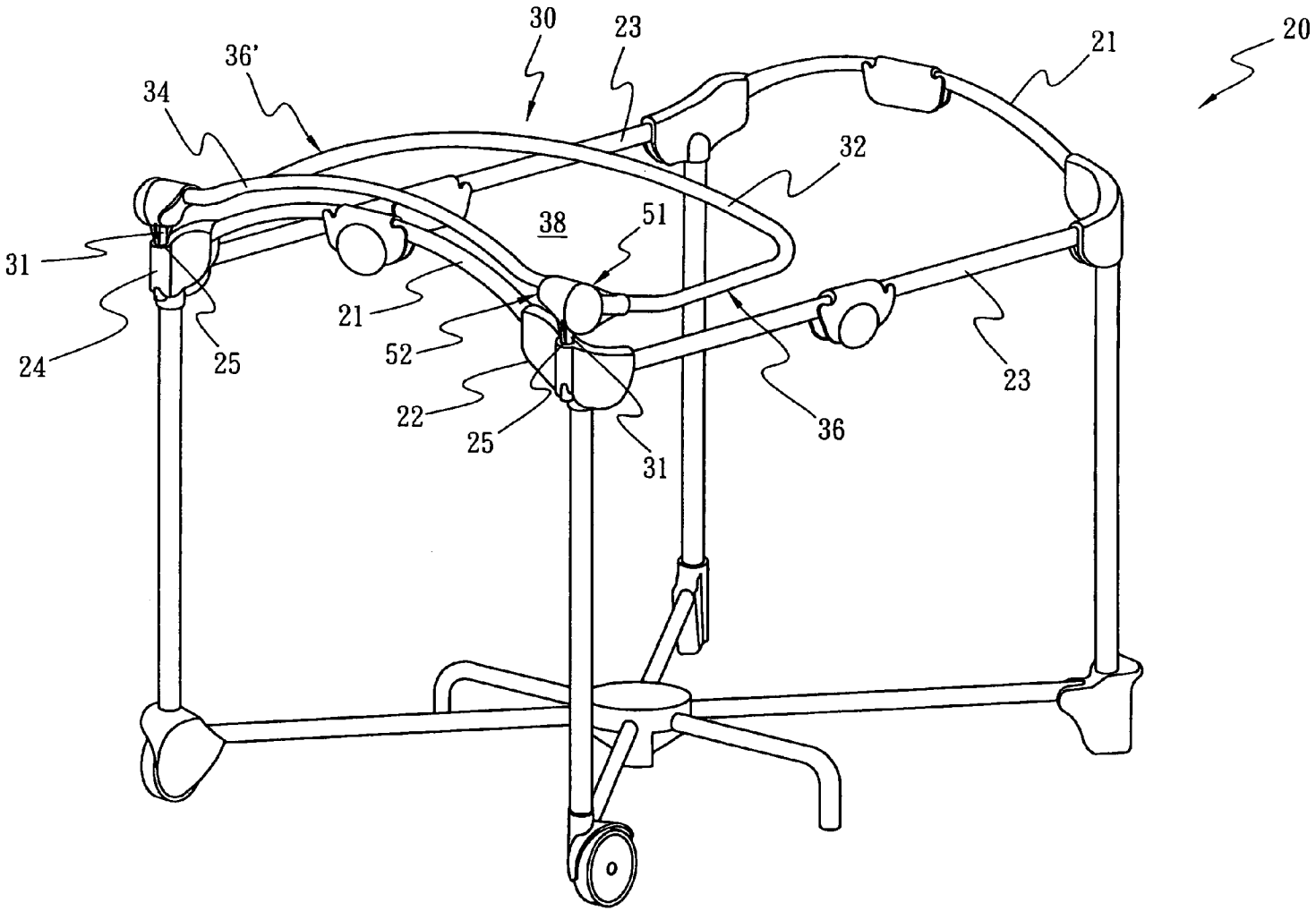
FIG. 1 is a schematic view showing a playard attached with a changing table in accordance with the present invention, in which the changing table is in an operation position.

Referring to the figures, wherein like numerals indicate like parts, and in particular to FIG. 1, a playard 20 is shown with a changing table 30 mounted thereto in accordance with the present invention. The playard 20 can be any conventional playard having at least one upper end rail member 21 and a pair of upper side rail members 23. In general, the upper side rail members 23 are connected to the upper end rail member 21 directly or via other structural members, such as legs, corner pieces 22, 24 etc.

Each of the corner pieces 22, 24 is provided with a slot 25 to receive the rod-like supporting member 31 of the changing table 30 so as to secure the changing table 30 to the playard 20.

Changing table 30 includes front and rear rails 32, 34 and a pair of side rails 36, 36' respectively connected to the front and rear rails 32, 34 to form a platform 38 rectangular or elliptical in shape.

The front rail 32 and the pair of side rails 36-36' may be separate components or integral formed. The changing table 30 is movable between an operation position and a storage position by the operation of a folding mechanism, which will be described in detail hereinafter.

Figure 2:
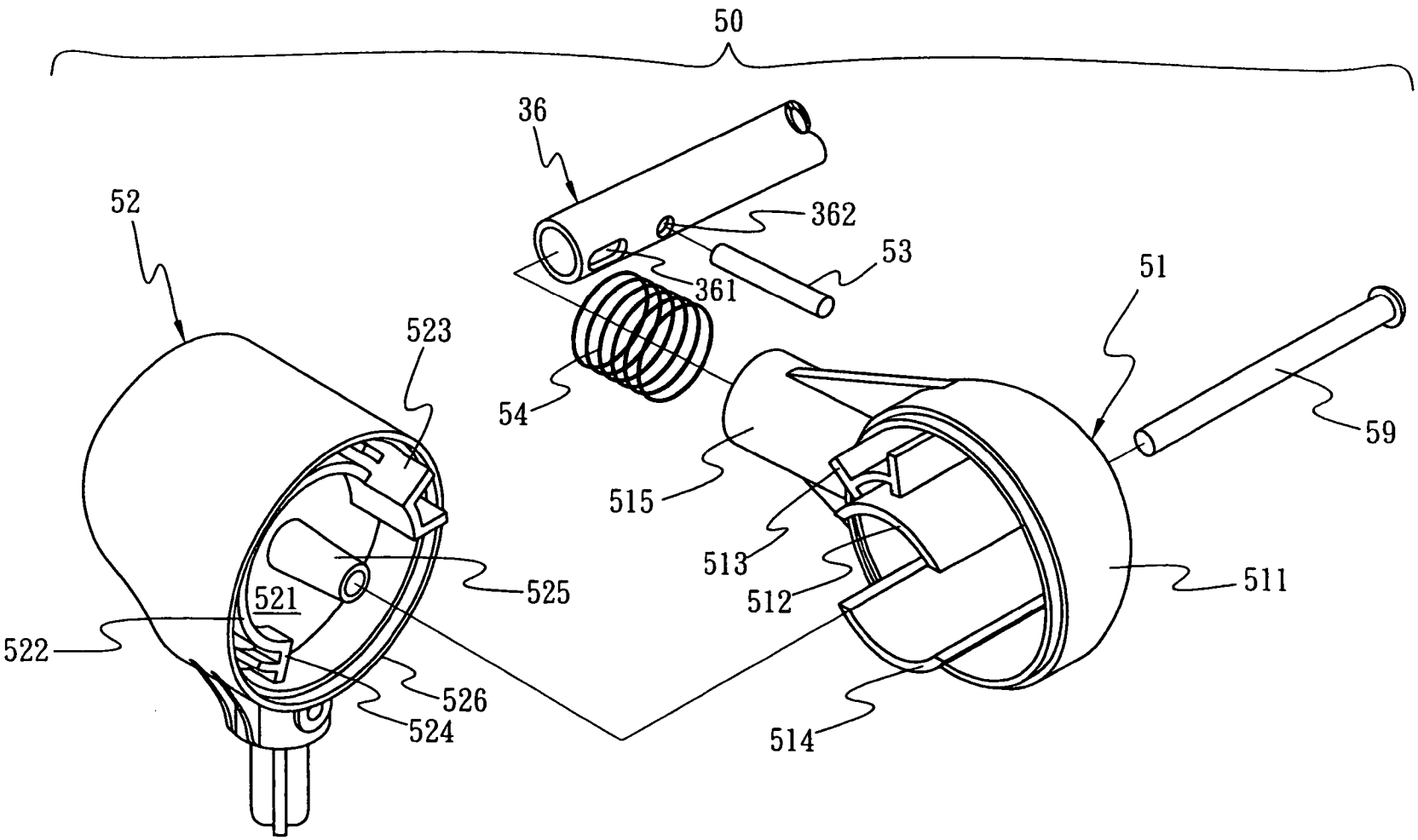
FIG. 2 is an exploded view of the folding mechanism in accordance with a preferred embodiment of the present invention.

FIG. 2 is an exploded view of the folding mechanism 50 in accordance with a preferred embodiment of the present invention. The folding mechanism 50 primarily comprises a first joint 51 connected to a side rail 36 at one end of the side rail 36, and a second joint 52 connected to the rear rail 34 at the rear end thereof (refer to FIG. 1).

Referring to FIG. 2, the first joint 51 is a substantially hollow cylindrical body with a closed end 511, and has an opening through which a fastener 59 may pass to connect the first joint 51 to the second joint 52. A pair of opposed arcuate plates 512, 514 extend upwardly (outwardly and toward the left as seen in FIG. 2) from the bottom wall of the closed end 511 of the first joint 51 and positioned opposite to each other.

The pair of arcuate plate 512-514 extend beyond the cylindrical body of the first joint 51, and the upper arcuate plate 512 bends downwardly, the lower arcuate plate 514 bends upwardly. A stop 513 extends from the upper side wall of the arcuate plate 512, and is cooperative with and corresponds to the stop 523 to be mentioned hereinafter. The second joint 52 is also a substantially hollow cylindrical body with a closed end. A fastener receiving portion 525 in a form of cylindrical post protrudes from the center of the second joint 52 for receiving the fastener 59. By inserting the fastener 59 through the opening (not shown) of the first joint 51, and then into the fastener receiving portion 525 of the second joint 52, the first joint 51 can be pivotally connected with the second joint 52.

Furthermore, the first joint 51 includes a receiving portion 515 at one side thereof to receive a portion of the side rail 36. The receiving portion 515 extends laterally from the one side of the first joint 51 and is formed of substantially hollow, cylindrical body, so that one end of the side rail 36 can be inserted and received therein. The side rail 36 is formed of a substantially hollow, and elongated cylindrical tube and includes a pair of opposed, horizontally extending and rectangular-shaped slots 361 near one end. Furthermore, an aperture 362 is provided at a predetermined distance from the slots 361 at the same level with the slots 361, for the insertion of a pin 53 therethrough and received therein. The slots 361 are configured to receive the fastener 59. It is appreciated that the elongate slots 361 can also be formed of a channel having an open end and a close end, so that a passage is provided to allow the side rail 36 to move to and fro when a force is applied to the side rails 36.

Figure 3:
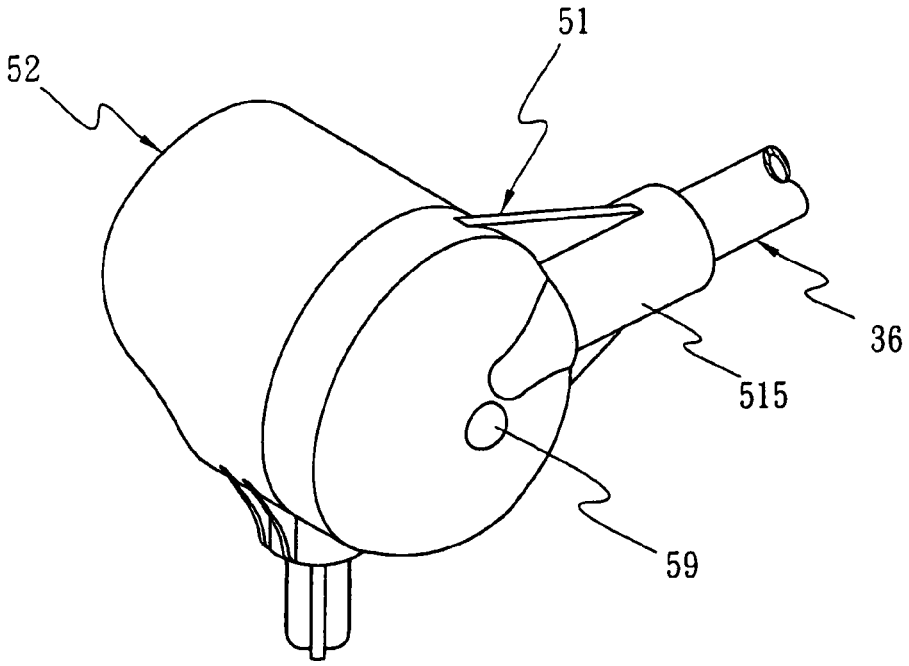
FIG. 3 is a perspective view showing the first and second joints are assembled.
Figure 4:
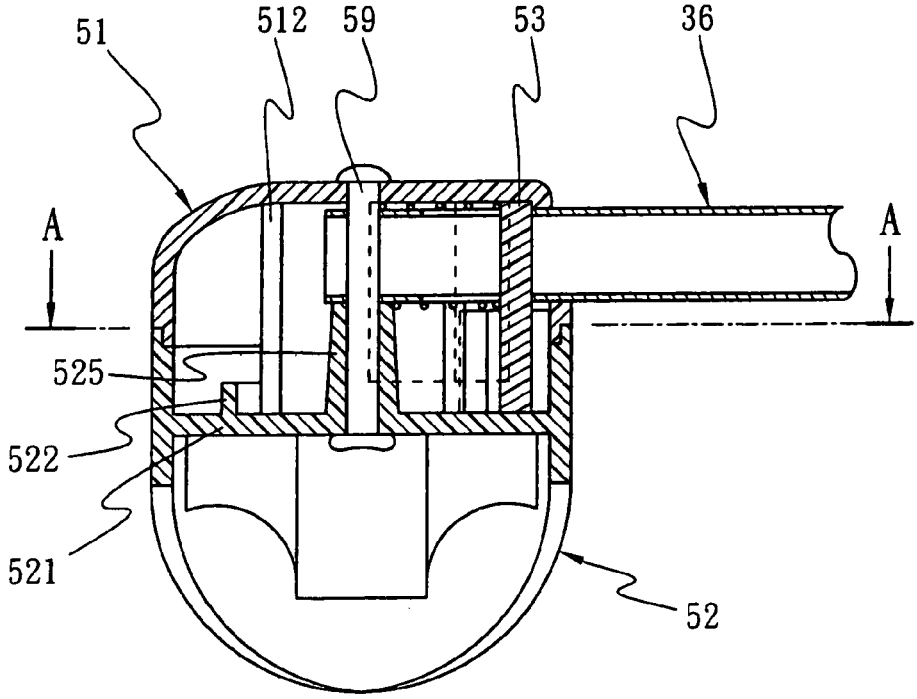
FIG. 4 is a sectional view taken along line B-B of FIG. 5, illustrating the assembly of the first and second joints.

In assembly, a spring 54 is mounted on the side rail 36, and inserted along with the side rail 36 into the first joint 51 and received therein. FIG. 3 is a perspective view showing the first joint 51 and second joint 52 are assembled and FIG. 4 is a sectional-view thereof. The fastener 59 is passed through the opening (not shown) of the first joint 51, and then into the fastener receiving portion 525 of the second joint 52, so that the first joint 51 is pivotally connected to the second joint 52. When the folding mechanism 50 is assembled, the side rail 36 is accommodated in the side rail receiving portion 515 of the first joint 51, the pin 53 is abutted against the side wall of the first joint 51 and the second joint 52, and the spring 54 located between the fastener 59 and the pin 53.

With reference to FIG. 4, the second joint 52 includes a cavity wall 521 at about half the axial length of the cylindrical body. An arcuate plate 522 substantially in the shape of a semi-circle extends upwardly (laterally as seen in FIG. 2) from the cavity wall 521, and is spaced from the peripheral wall 526 of the second joint 52 at a predetermined distance. The arcuate plate 522 of the second joint 52 corresponds to the arcuate plates 512, 514 of the first joint 51, and thus the arcuate plates may contact with each other.

Therefore, arcuate plates 512, 514 may cooperate with arcuate plate 522, and serve the purpose of guiding when the first joint 51 rotates relative to the second joint 52. In other words, when the two joints rotate relative to each other, arcuate plates 512, 514 will rotate along the inner wall of arcuate plate 522, so that the two joints are in alignment with each other.

Figure 5:
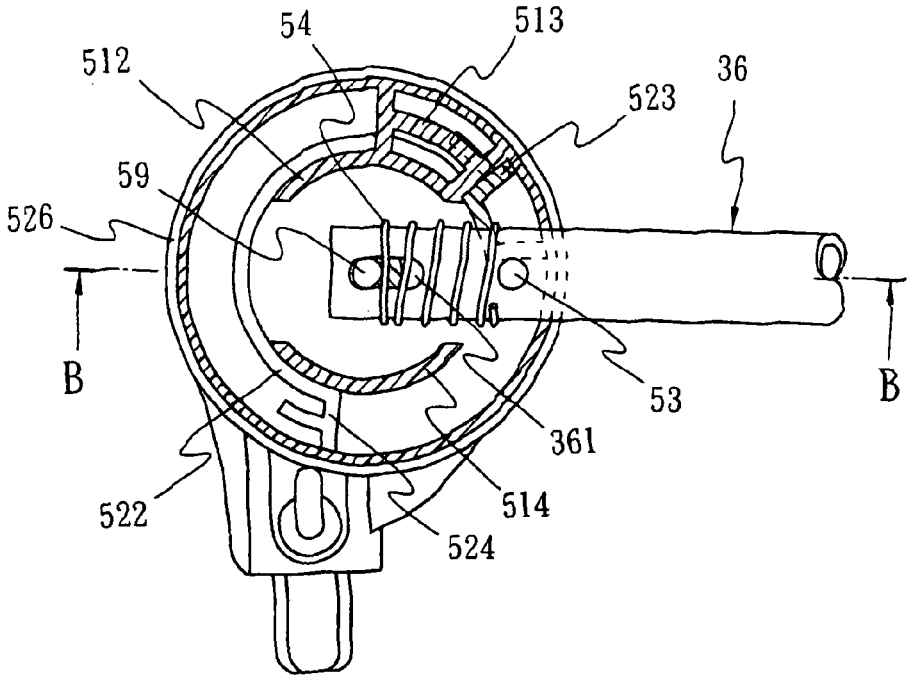
FIG. 5 is a sectional view taken along line A-A of FIG. 4, illustrating the assembly of the first and second joints.

FIG. 5 is a sectional view taken along line A-A of FIG. 4, which illustrates the assembly of the first and second joints 51, 52.

Referring to FIGS. 4 and 5, the arcuate plate 522 of the second joint 52 is formed of a stop 523 at one end thereof (at the upper right corner in FIG. 5), while the other end is formed of a stop 524 (at the lower position in FIG. 5). As mentioned above, the fastener receiving portion 525 formed of a substantially hollow, cylindrical body protrudes from the center of the second joint 52 for receiving the fastener 59.

FIG. 5 also shows the state of the folding mechanism 50 in which the changing table 30 is in the operation position. In this state, the pin 53 is blocked by the stop 523 of the second joint 52 to prevent the side rails 36 (and hence the changing table 30) from being lifting, so that the changing table 30 is kept in the operation position. Besides, the stop 513 of the first joint 51 and the stop 523 of the second joint 52 engage with each other, and thus the first joint 51 cannot rotate with respect to the second joint 52, thereby preventing the changing table 30 from being pressed downwards, and this is the bearing point for the load of the changing table 30. At this state, the user or caretaker can change a child's diaper or perform other baby caretaking tasks on the changing table 30 at ease.

Figure 6:
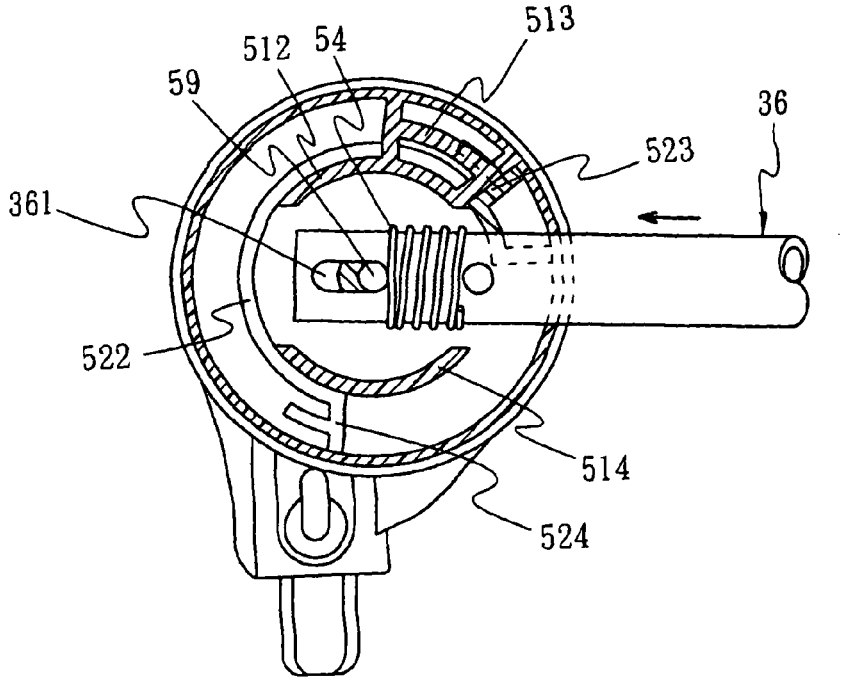
FIGS. 6 to 8 illustrate the folding mechanism in accordance with the preferred embodiment of the present invention when the changing table is moved from a operation position to a storage position.
Figure 7:
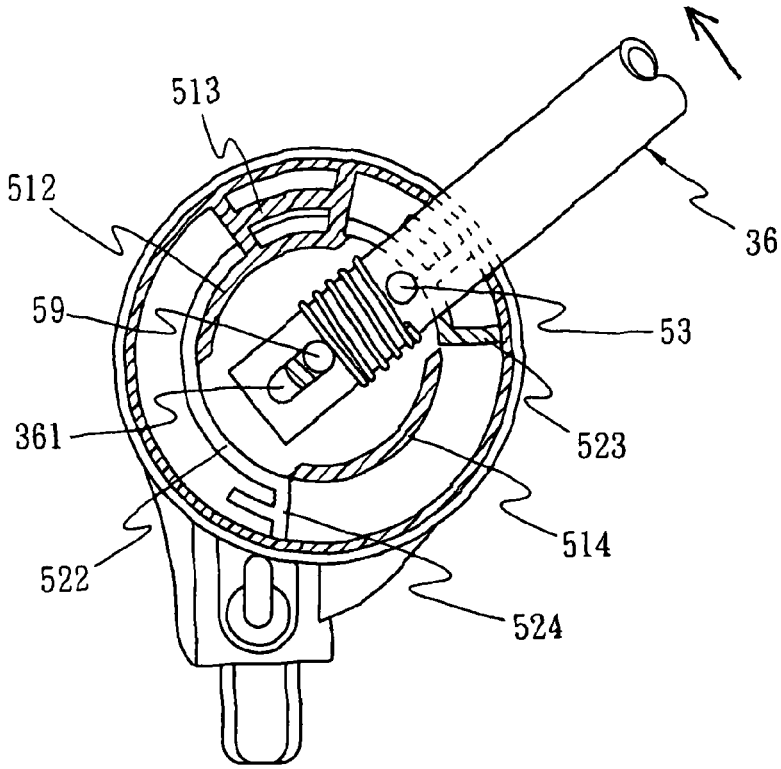

Referring to FIG. 6, after the user or caretaker has finished changing a child's diaper or performing baby caretaking tasks, to move the changing table 30 to its storage position, the user only has to press the front rail 32 by one hand. As the side rail 36 is forced, to move inwards (leftwards in FIG. 5) in the folding mechanism 50, so that the spring 54 is compressed. As the side rail 36 has a horizontally extending slot 361 at one end, the side rail 36 may move with respect to the first joint 51. The pin 53 secured in the opening 362 of the side rail 36 also moves inwards (leftwards) simultaneously, causing the pin 53 to remove away from the stop 523 of the second joint 52. Subsequently, the side rails 36 can be lifted along in the direction as shown by the arrow in FIG. 7 and the changing table is further to be in the folding/storage position.

Figure 8:
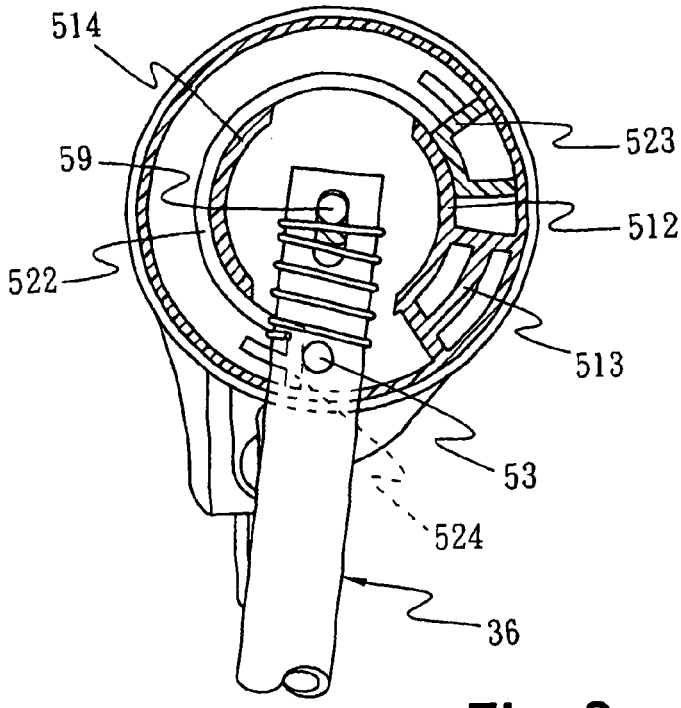

Referring to FIG. 8, when the changing table 30 is swung to move to the storage position by the rotation movement of the side rail 36, one end of the side rail 36 will move outwardly (substantially downwards as seen in FIG. 8) in the folding mechanism 50 to restore to its original position due to the restoring force of the compression spring 45. The pin 53 mounted within the opening 362 of the side rail 36 moves outwards (downwards) simultaneously, resulting in the engagement of the pin 53 with the stop 524 of the second joint 52, to thereby locking the changing table 30 in the storage position.

When it is desired to swing the changing table 30 back to its operation position, the user only has to press the front rail 32 by one hand to subject a force on the side rail 36, causing the pin 53 to disengage from the stop 524 of the second joint 52. In this manner, the changing table 30 can be raised along with the side rails 36 and rotated to return to its operation position.

Figure 9:
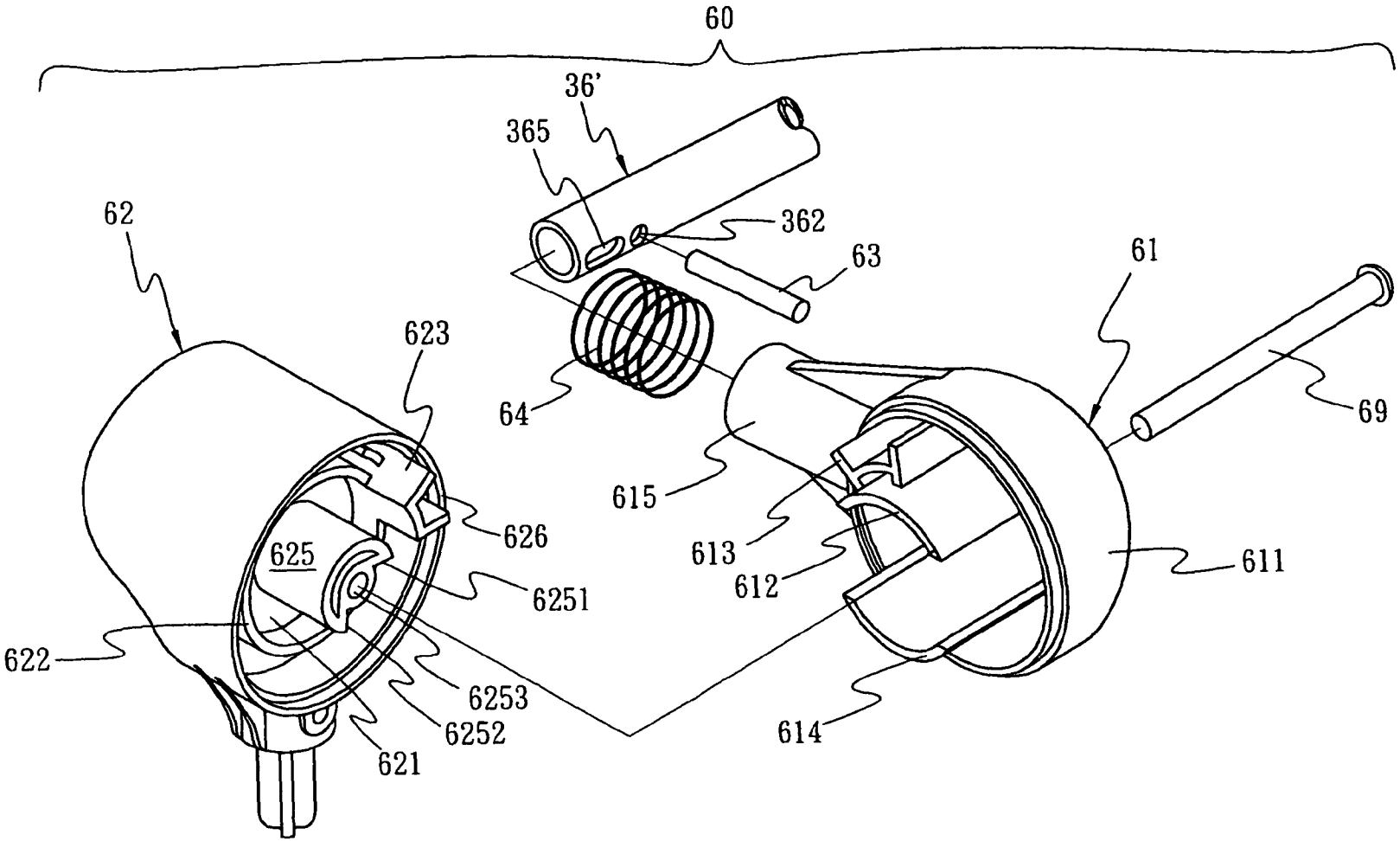
FIG. 9 is an exploded view of the folding mechanism in accordance with an alternate embodiment of the present invention.

FIG. 9 is an exploded view of the folding mechanism 60 in accordance with an alternate embodiment of the present invention. This folding mechanism 60 is somewhat similar to the folding mechanism 50 of the first embodiment, and primarily comprises a first joint 61 and a second joint 62.

The first joint 61 is similar to the first joint 51 of the folding mechanism 50 in the aforementioned embodiment in structure, and is formed of a substantially hollow and cylindrical body, and is attached to a second joint 62 by a fastener 69. The first joint 61 also has a pair of opposed arcuate plates 612, 614, in which the upper arcuate plate 612 curves downwardly, and the lower arcuate plate 614 curves upwardly. A stop 613 extends from the upper side wall of the arcuate plate 612, and abutted against a stop 623 to be mentioned hereinafter.

The second joint 62 is also formed of a substantially cylindrical body closed at one end and opened at the other end. The second joint 62 includes a cavity wall 621 at about half the axial length of the cylindrical body. An arcuate plate 622 substantially in the shape of a circle extends upwardly from the cavity wall 621, and is spaced from the peripheral wall 626 of the second joint 62 at a predetermined distance. The arcuate plate 622 of the second joint 62 corresponds to the arcuate plates 612, 614 of the first joint 61. Therefore, arcuate plates 612, 614 may cooperate with arcuate plate 622, and serve the purpose of guiding when the first joint 61 rotates relative to the second joint 62. In other words, when the two joints rotate relative to each other, arcuate plates 612, 614 will rotate along the inner wall of arcuate plate 622, so that the two joints are in alignment with each other.

A stop 623 extends from the upper side wall of the arcuate plate 622, and is abutted against the stop 613 to be mentioned hereinafter.

Figure 11:
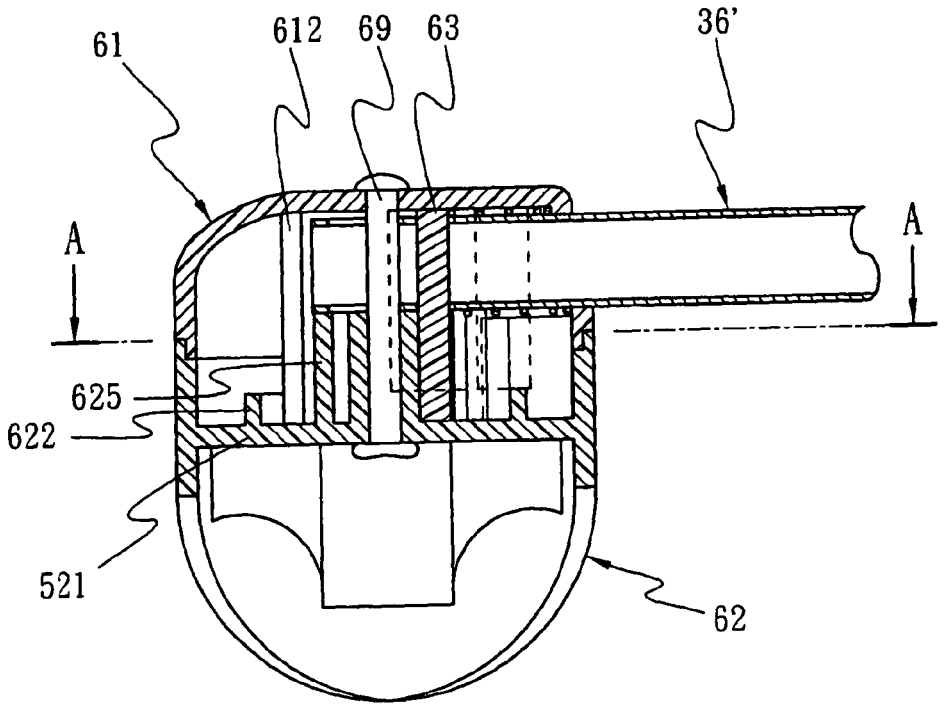
FIG. 11 is a sectional view taken along line B-B of FIG. 12, illustrating the assembly of the first and second joints.

A fastener receiving portion 625 protrudes from the center of the cavity wall 621 of the second joint 62. The fastener receiving portion 625 includes an opening 6253 in the center thereof to receive a fastener 69. The fastener 69 is passed through the opening (not shown) of the first joint 61, and then into the opening 6253 of the fastener receiving portion 625 of the second joint 62, so that the first joint 61 is pivotally connected to the second joint 62. The fastener receiving portion 625 is formed of a substantially cylindrical body, but chamfered at the right lower corner. Referring to FIGS. 9 and 11, it can be seen that the fastener receiving portion 625 includes a horizontally face 6251 and a vertically face 6252, which may serve as stops (to be described hereinafter).

The first joint 61 is similar to the first joint 51 of the previous embodiment in that it also has a side rail receiving portion 615 to accommodate one end of the side rail 36'. The side rail 36' is also formed of a substantially hollow tube, and includes a pair of opposed, horizontally extending slots 365. Furthermore, an aperture 362 is provided at a predetermined distance from the slots 365 at the same level with the slots 365, for the insertion of a pin 63 therethrough and received therein. The slots 365 are configured to receive the fastener 69. It is appreciated that the slots 365 can also be formed of a channel having an open end and a close end, so that a passage is provided to allow the side rail 36' to move to and fro when a force is applied to the side rails 36'. In assembly, the spring 64 is mounted on the side rail 36', and inserted along with the side rail 36' into the first joint 61 and received therein. Besides, the spring 64 is located between the pin 63 and the peripheral wall of the first joint 61.

Figure 10:
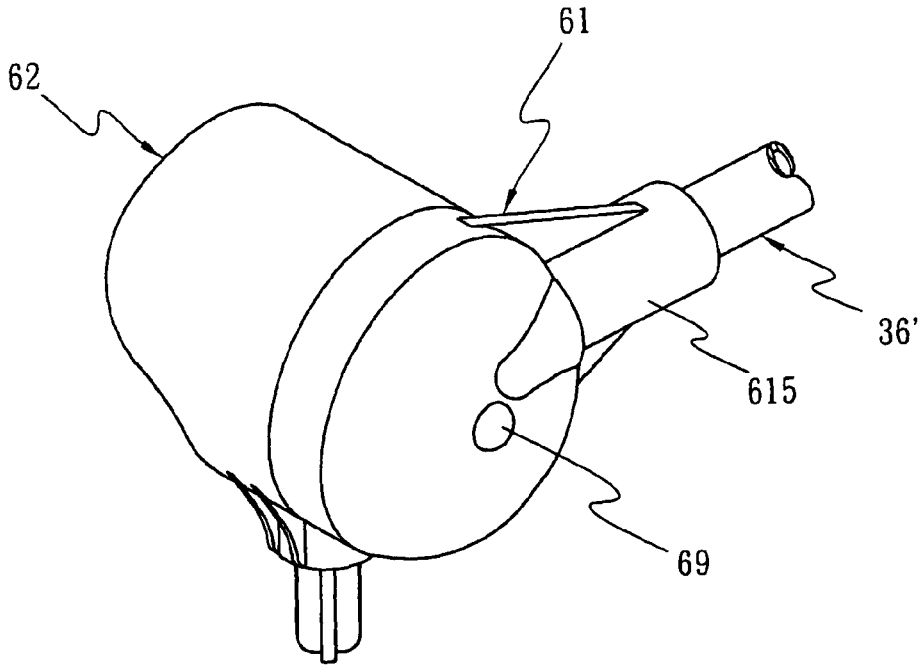
FIG. 10 is a perspective view showing the assembly of the first and second joints.

FIGS. 10 and 11 illustrate respectively the perspective view and sectional-view of the first joint 61 and second joint 62 after assembly. The assembly is achieved by inserting the fastener 69 through an opening (not shown) of the first joint 61, and then into opening 6253 of the fastener receiving portion 625 of the second joint 62, so that the first joint 61 is pivotally connected to the second joint 62. In the assembled state, the side rail 36' is accommodated in the side rail receiving portion 615 of the first joint 61, in which the slot 365 thereof receives the fastener 69 which is then secured in the fastener receiving portion 625 of the second joint 62.

Figure 12:
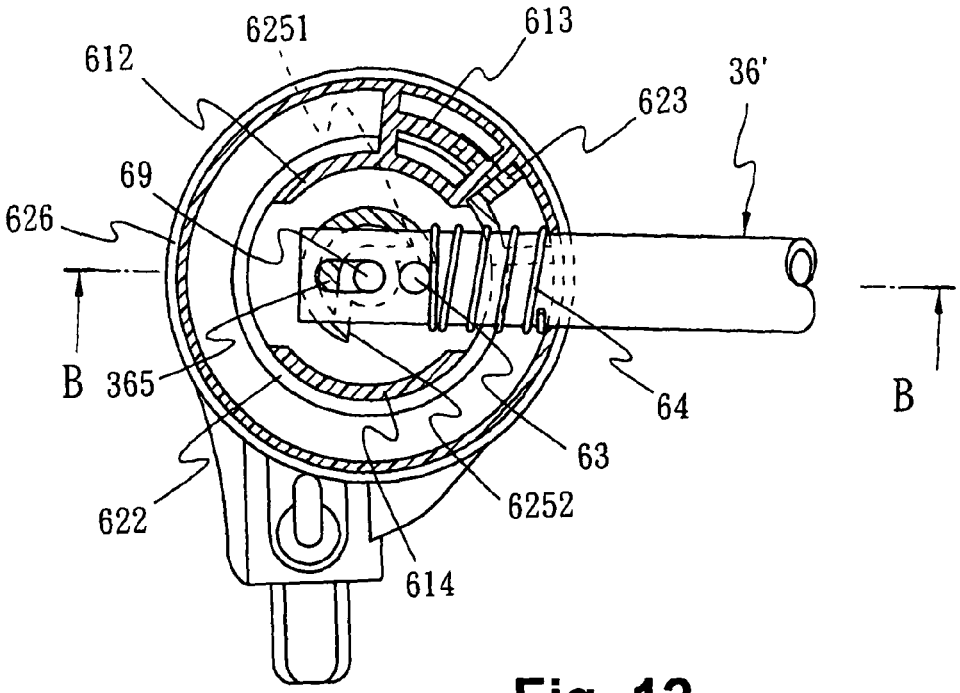
FIG. 12 is a sectional view taken along line A-A of FIG. 11, illustrating the assembly of the first and second joints.

FIG. 12 is a sectional view taken along line A-A of FIG. 11, which illustrates in detail the assembly of the first and second joints 61, 62.

FIG. 12 also shows the state of the folding mechanism 60 for rotatably folding/unfolding the changing table in which the changing table 30 is in the operation position. In this state, the pin 63 is blocked by the horizontally face 6251 of the fastener receiving portion 625 of the second joint 62 to prevent the side rails 36' (and hence the changing table 30) from being lifting, so that the changing table 30 is kept in the operation position. Besides, the stop 613 of the first joint 61 and the stop 623 of the second joint 62 engage with each other, and thus prevents the changing table 30 from being pressed downwards. At this state, the user or caretaker can change a child's diaper or perform other baby caretaking tasks on the changing table 30 at ease.

Figure 13:
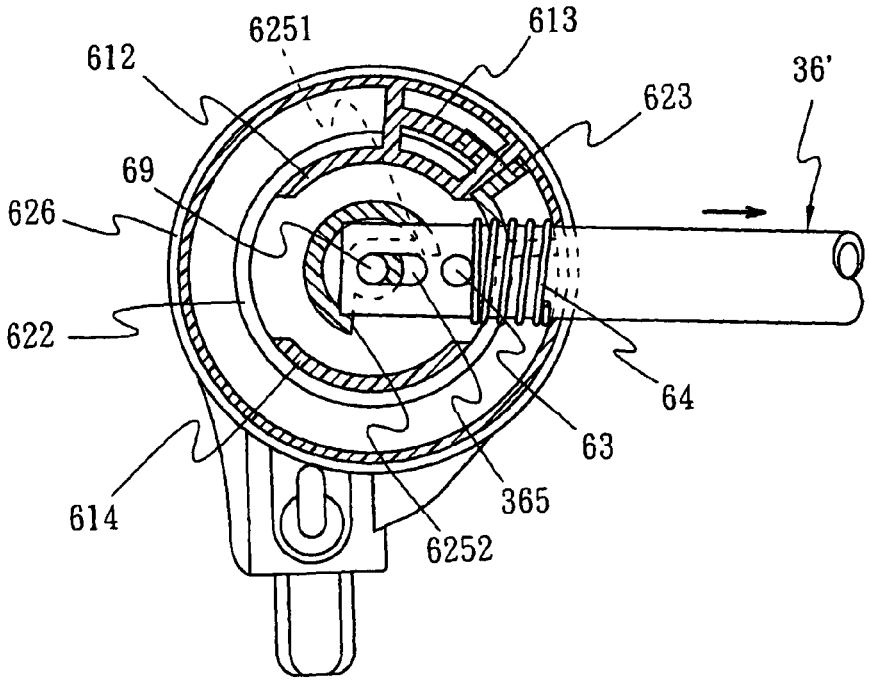
FIGS. 13 to 15 illustrate the working of the joints when the changing table is moved from a operation position to a storage position.
Figure 14:
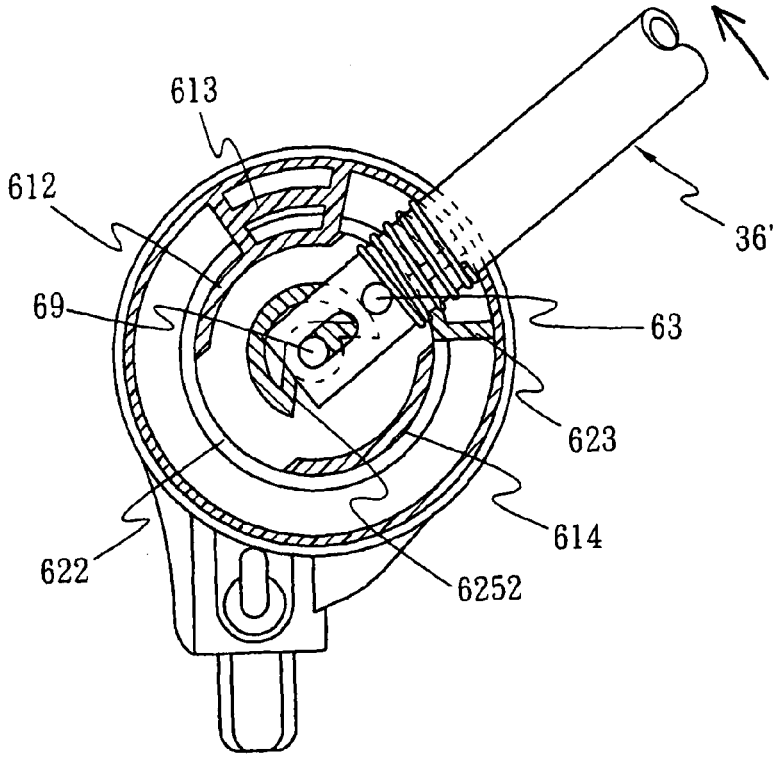
Figure 16:
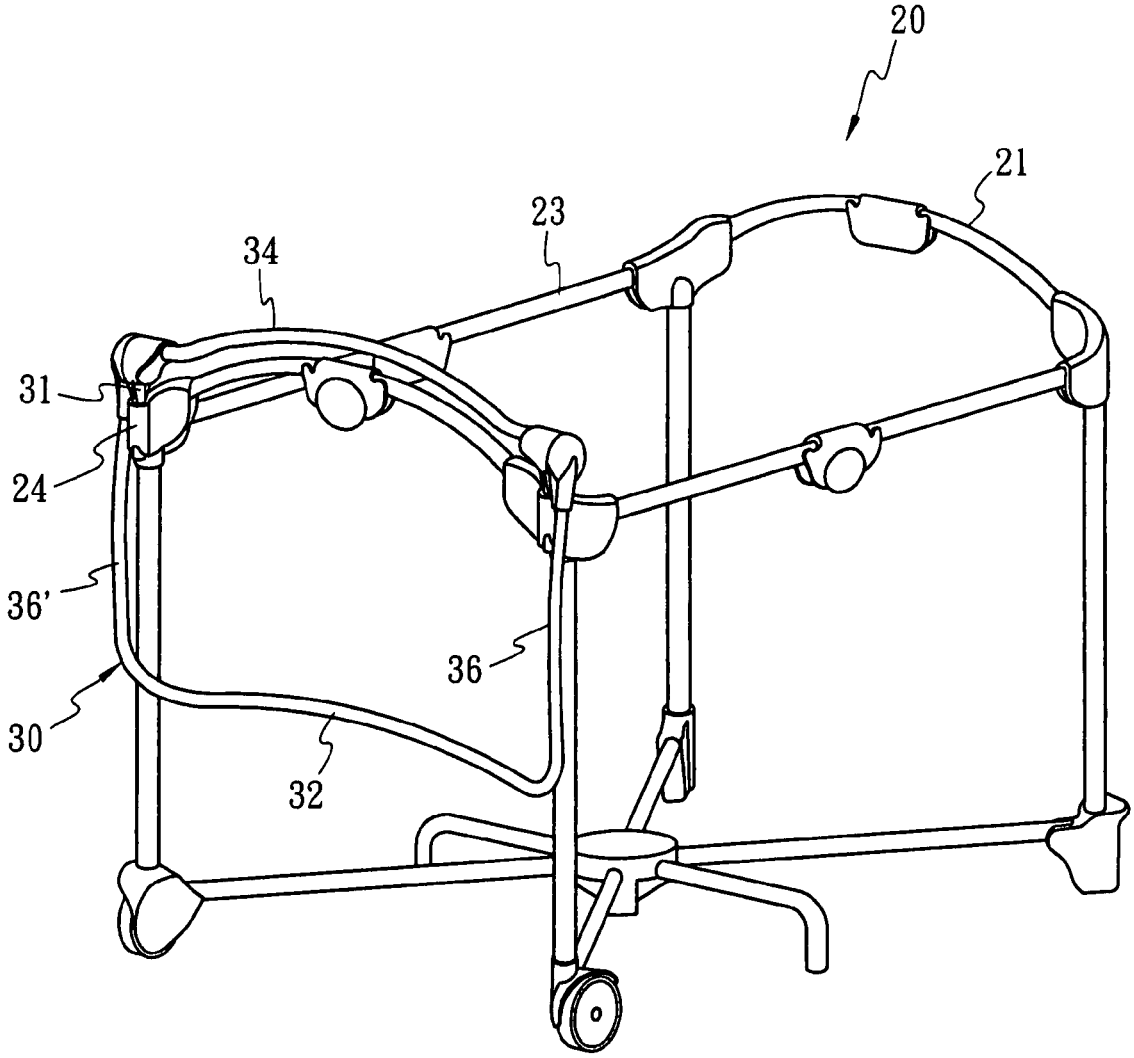
FIG. 16 is a schematic view showing a playard attached with a changing table in accordance with the present invention, in which the changing table is in a storage position.

Referring to FIG. 13, after the user or caretaker has finished changing a child's diaper or performing baby caretaking tasks, to move the changing table 30 to its storage position (as shown in FIG. 16), the user only has to pull the front rail 32 by one hand. As the side rail 36' is forced to move outwards (rightwards in FIG. 13) in the folding mechanism 60, so that the spring 64 is compressed. As the side rail 36' has a slot 365 at one end, the side rail 36' may move with respect to the fastener 69 outwards (rightwards) until the left side wall of the slot 365 urges against the fastener 69. The pin 63 secured in the opening 366 of the side rail 36' also moves outwards (rightwards) simultaneously, causing the pin 63 to remove away from the horizontally face 6151 of the fastening receiving portion 625 of the second joint 62. Subsequently, the side rails 36' can be lifted along the direction as shown by the arrow in FIG. 14 and the changing table 30 is further to be in the folding/storage position.

Figure 15:
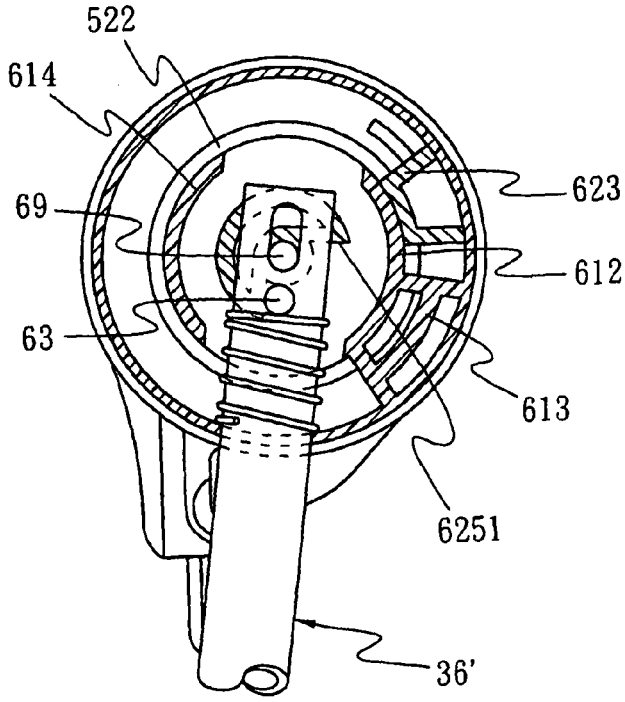

Referring to FIG. 15, when the changing table 30 is swung to move to the storage position by the rotation movement of the side rail 36, 36', one end of the side rail will move inwardly (substantially upwards as seen in FIG. 15) in the folding mechanism 60 to restore to its original position due to the restoring force of the spring 64. The pin 63 secured in the opening 366 of the side rail moves inwards (upwards) simultaneously, resulting in the engagement of the pin 63 with the vertically face 6252 of the fastening receiving portion 625 of the second joint 62, to thereby locking the changing table 30 even when it is in the storage position.

When it is desired to swing the changing table 30 back to its operation position, the user only has to pull the front rail 32 by one hand to subject a force on the side rails 36, 36' causing the pin 63 to disengage from the vertically face 6252 of the fastening receiving portion 625 of the second joint 62. In this manner, the changing table 30 can be raised along with the side rails 36, 36' and rotated to return to its operation position.

Furthermore, the above embodiments can be modified in a number of ways. For example, the front end of the rail 36 does not necessarily to have a slot or opening, nor have to connect to the fastener 69, and the spring 64 does not necessarily have to be located between the pin 63 and the peripheral wall. Such modified embodiment includes a spring to connect the pin 63 and fastener 69 instead. In the general state, the rail 36 moves inwardly due to the spring, and when it is intended to fold the changing table, it is only necessary to pull the rail 36 outwards.

Although the foregoing has been described in terms of presently preferred and alternate embodiments, those skilled in the art will recognize that the invention is not limited to the embodiments described. The apparatus of the present invention can be practiced with modification and alteration within the spirit and scope of the appended claims. The description is thus to be regarded as illustrative instead of limiting the present invention.

We claim:

1. A changing table for a playard comprising a first rail, a second rail in parallel and opposite to the first rail, and a pair of side rails respectively connected to the first and second rails to form a platform, wherein the changing table comprises:

a first joint formed of a substantially cylindrical body and having a receiving portion at one side to slidably receive the side rail and having a first blocking member protruding from one end of the cylindrical body;

a second joint provided at one end of the first rail, the second joint is formed of a substantially cylindrical body and having a second blocking member protruding from one end thereof, the second blocking member corresponds to the first blocking member of the first joint;

wherein the first and second joints are adapted to pivotally connect to each other in such a manner that the first and second blocking members operatively engage each other to form a blocking device; and the side rail is movable between a first position in which the side rail is stopped by the blocking device such that the first joint is unable to pivot relative to the second joint, and a second position in which the side rail is not stopped by the blocking device such that the first joint is able to pivot relative to the second joint.

2. The changing table according to claim 1, further comprising a pin disposed on the side rail, the pin is stopped by the blocking device when the side rail is in the first position.

3. The changing table according to claim 2, wherein a pair of opposed slots is provided at one end of the side rail for receiving the fastener.

4. The changing table according to claim 2, wherein the first blocking member of the first joint cooperates with the pin to abut against two sides of the second blocking member of the second joint when the changing table is in the operation position.

5. The changing table according to claim 4, wherein the first joint comprises an upper and lower arcuate plates opposite to each other, the first blocking member is extended from the sidewall of the upper arcuate plate, the second joint includes an arcuate plate corresponding to the upper and lower arcuate plates of the first joint to guide and facilitate the relative rotation between the first and second joints.

6. The changing table according to claim 1, further having a spring member for restoring the side rail to the first position.

7. A changing table for a playard comprising a first rail, a second rail, and a pair of side rails respectively connected to the first and second rails to form a platform, wherein the changing table comprises:

a first joint formed of a substantially hollow cylindrical body with a closed end having an opening defined therethrough, at least an arcuate plate protrudes from the closed end, and a first blocking member extends from the side wall of the arcuate plate, the first joint includes a receiving portion at one side to receive a portion of the side rail; and a second joint provided at one end of the first rail, the second rail is a substantially hollow cylindrical body with a closed end, a fastener receiving portion protrudes from the center of the bottom wall of the closed end, and a fastener can extend through the opening provided at the closed end of the first joint and into the fastener receiving portion of the second joint to pivotally connect the first joint to the second joint, an arcuate plate substantially in the shape of a semi-circle, and corresponding to the arcuate plate of the first joint protrudes from the closed end of the second joint, the arcuate plate of the second joint has an upper second blocking member at one end thereof, the second blocking member abuts against one side of the first blocking member;

the side rail is formed of a hollow cylindrical body, and includes a pair of opposed, horizontally extending slots at the one end received in the receiving portion of the first joint, the slots allow a fastener extending through the first joint, and provide a passage for the side rail to move to and fro when a force is applied to the side rail, an opening is provided at a predetermined distance from the slots for receiving a pin that is abutted against the other side of the first blocking member, so as to maintain the changing table in the operating position, when the side rail moves with respect to the first rail, the pin moves away from the upper stop, so that the first joint is rotated with respect to the second joint, and the changing table is moved to a storage position;

a spring is provided near one end of the side rail and received in the first joint along with the side rail for urging the side rail to restore to the first position.

8. The changing table according to claim 7, wherein the arcuate plate of the second joint includes a lower stop at the other end thereof, and the pin abuts against the lower stop when the changing table is in the storage position.

9. A changing table for a playard comprising a first rail, a second rail, and a pair of side rails respectively connected to the first and second rails to form a platform, wherein the changing table comprises:

a first joint formed of a substantially cylindrical body closed at one end and opened at the other end, the closed end has an opening defined therethrough, at least an arcuate plate protrudes from the bottom wall of the closed end, and a stop extends from the side wall of the arcuate plate, the first joint includes a receiving portion at one side thereof to receive a portion of the side rail; and a second joint formed of a substantially cylindrical body closed at one end and opened at the other end, a receiving portion protrudes from the center of the bottom wall of the closed end, and includes an opening at the center thereof to allow a fastener to extend therethrough, so that the fastener can extend through the opening provided at the closed end of the first joint, and into the receiving portion of the second joint to connect the first joint to the second joint; the receiving portion is formed of cylindrical body chamfered at the right lower corner to include a horizontally face and a vertically face, an arcuate plate substantially circular in shape, and corresponding to the arcuate plate of the first joint protrudes from the bottom wall of the closed end of the second joint, the arcuate plate of the second joint has a stop at the periphery thereof to cooperate with the stop of the first joint;

the side rail is formed of a hollow cylindrical body, and includes a pair of opposed, horizontally extending slots at the one end received in the receiving portion of the first joint, the slots allow a fastener extending through the first joint, and provide a passage for the side rail to move to and fro when a force is applied to the side rail, an opening is provided at a predetermined distance from the slots for receiving a pin that is abutted against the horizontally face of the receiving portion of the second joint, so as to maintain the changing table in the operating position, when the side rail moves with respect to the first rail, the pin moves away from the horizontally face, so that the first joint is rotated with respect to the second joint, and the changing table is moved to a storage position, and the pin urges against the vertically face;

a spring is provided in vicinity of the one end of the side rail and received in the first joint along with the side rail for urging the side rail to restore to its original position.

10. A changing table for a playard comprising:

a first rail, a second rail in parallel and opposite to the first rail, a pair of side rails respectively connected to the second rail at one end, and pivotally connected to the first rail at the other end by means of a joint device, wherein each side rail is slidably mounted in the joint device and movable between a first position in which the side rail is locked relative to the first rail and a second position in which the side rail is able to rotate relative to the first rail, and wherein the joint device includes a first joint provided at the other end of the side rail and a second joint pivotally connected to the first joint attached to one end of the first rail, the second joint has a supporting member configured to be attached to the playard.

11. The changing table according to claim 10, wherein the first joint has a first blocking element extending therefrom, and the second joint has a second blocking element extending therefrom to cooperate with the first blocking element to lock the side rail with respect to the first rail.

12. The changing table according to claim 1, wherein the second blocking member includes a substantially circular, arcuate plate having stop means at a predetermined location, and the first blocking member includes a lower arcuate plate formed of a substantially semi-circular plate, and an upper plate formed of a substantially semi-circular plate having stop means thereon, the arcuate plate of the second blocking member serves as a guide for the upper and lower arcuate plates of the first blocking member to rotate thereon, so that the first and second joints can rotate with respect to each other, and the relative rotation between the first and second joints is stopped when the stop means of the upper arcuate plate of the first blocking member abut against the stop means of the arcuate plate of the second blocking member.

13. The changing table according to claim 1, wherein the second blocking member further includes a fastener receiving portion having an opening for receiving a fastener passing through an opening of the first joint, the fastener serves to pivotally connect the first and second joints together.

14. The changing table according to claim 13, wherein the fastener receiving portion further includes a horizontal face and a vertical face configured to lock the pin at predetermined positions.

* * * * *